United States Patent [19]

Stedman

[11] 4,074,768

[45] Feb. 21, 1978

[54] BLADE SUPPORT AND CONTROL ARRANGEMENT FOR A MOTOR GRADER

[75] Inventor: Robert N. Stedman, Chillicothe, Ill.

[73] Assignee: Caterpillar Tractor Co., Peoria, Ill.

[21] Appl. No.: 719,003

[22] Filed: Aug. 30, 1976

[51] Int. Cl.[2] ..... E02F 3/76

[52] U.S. Cl. ..... 172/796; 172/484; 172/742

[58] Field of Search ..... 172/781, 782, 783, 784, 172/785, 786, 787, 788, 789, 790, 791, 792, 793, 794, 795, 796, 797, 799, 804, 484, 741, 742, 744

[56] References Cited

U.S. PATENT DOCUMENTS

| | | | |
|---|---|---|---|
| 2,147,631 | 2/1939 | Arndt | 172/793 |
| 2,195,607 | 4/1940 | Wilson et al. | 172/793 |
| 3,454,110 | 7/1969 | Hanser | 172/793 |
| 3,568,778 | 3/1971 | Swisher, Jr. et al. | 172/785 |

FOREIGN PATENT DOCUMENTS

| | | | |
|---|---|---|---|
| 2,139,937 | 2/1973 | Germany | 172/796 |

*Primary Examiner*—Richard T. Stouffer
*Attorney, Agent, or Firm*—Phillips, Moore, Weissenberger, Lempio & Majestic

[57] ABSTRACT

A motor grader comprises a tractor having a frame extending forwardly therefrom and supported on a plurality of road wheels. A first bracket is universally connected to the frame and is pivotally connected to a second bracket, disposed forwardly thereof, by a parallelogram-type linkage. A double-acting hydraulic cylinder is pivotally interconnected between the first and second brackets to selectively pivot the second bracket relative to the first bracket and to maintain the brackets in parallel relationship relative to each other. A mold board is mounted for lateral sliding movements on a support member pivotally connected to a forward end of the second bracket. A pair of cylinders are pivotally interconnected between the second bracket and the support member to selectively pivot the support member and mold board relative to the second bracket. A pair of generally vertically disposed cylinders are pivotally interconnected between the frame and the second bracket to selectively raise and lower the second bracket and attached mold board relative to ground level. The mold board may be moved relative to the support member by a cylinder pivotally interconnected therebetween and another cylinder is interconnected between first and second pivoted parts of the support member to selectively tip the mold board.

17 Claims, 6 Drawing Figures

BLADE SUPPORT AND CONTROL ARRANGEMENT FOR A MOTOR GRADER

BACKGROUND OF THE INVENTION

A conventional motor grader normally comprises a tractor having a frame extending forwardly therefrom and supported by a plurality of road wheels. A circle drawbar is suspended below the frame by a pair of links and attendant support struts. A mold board is mounted beneath the circle drawbar and means are provided for lifting, tipping, shifting and rotating the mold board to position it for various grading operations.

The motor grader is normally of the pull-bar type wherein front road wheels mounted on the forward end of the frame have a restricted turning radius. Furthermore, the side reach of the mold board is restricted due to the construction and arrangement of the circle drawbar. In addition, the mold board cannot be disposed substantially vertically to perform work tasks, such as side bank cuts, due to interference with the frame and attendant structures employed on the motor grader.

SUMMARY OF THE INVENTION

An object of this invention is to provide an improved support and control arrangement for the work tool of a construction vehicle, preferably the mold board or blade employed on a motor grader. Such arrangement substantially increases the side reach of the blade and permits substantial universal movement thereof to effect various earth cutting or grading operations. For example, the blade is adapted to be positioned substantially vertically to perform a left or right side bank cut. In addition, front road wheels of the motor grader are adapted to be turned 180° C to substantially increase the mobility thereof.

The motor grader comprises a frame extending forwardly thereof and a first bracket pivotally connected to the frame. A second bracket is pivotally connected to the first bracket by linkage means for maintaining the brackets substantially parallel when a first actuation means, pivotally interconnected between the brackets, moves the second bracket relative to the first bracket. A work tool assembly, which may comprise the above-mentioned mold board or blade, is pivotally mounted on the second bracket and second actuating means are pivotally interconnected between the second bracket and the work tool assembly for pivoting the work tool assembly relative to the second bracket.

In the preferred embodiment of this invention, third actuation means, preferably comprising a pair of double-acting hydraulic cylinders, are pivotally interconnected between the frame and the second bracket to selectively tilt the blade from its normal ground engaging and horizontally disposed position to a vertically disposed position along side the frame. In addition, the work tool preferably comprises a support member having the blade slidably mounted for lateral movements thereon and an actuating means is interconnected between the support structure and the blade to shift the blade laterally thereon. The first part of the support member, having the blade slidably mounted thereon, may be pivotally mounted on a second part thereof and another actuating means is pivotally interconnected between the first and second parts of the support member to tip the blade.

BRIEF DESCRIPTION OF THE DRAWINGS

Other objects of this invention will become apparent from the following description and accompanying drawings wherein.

DETAILED DESCRIPTION

Figure 1:
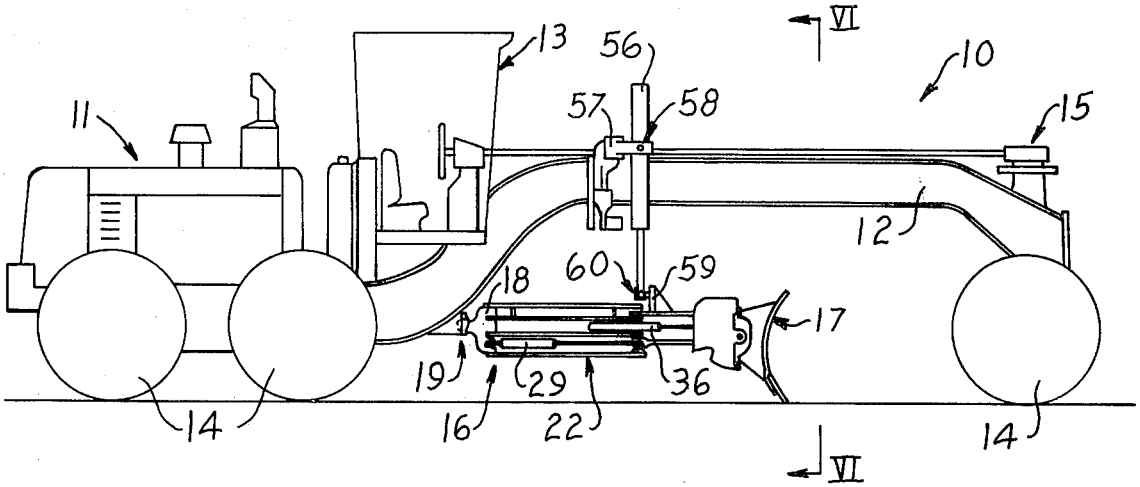
FIG. 1 is a side elevational view of a motor grader having the support and control arrangement of this invention mounted thereon.

FIG. 1 illustrated a motor grader 10 comprising a tractor portion 11 having a main frame 12 extending forwardly therefrom. An operator's cab 13 is mounted on the frame and the frame is supported on three pairs of ground-engaging road wheels 14. A conventional steering gear and valve arrangement 15 is mounted forwardly on the frame to selectively steer the front road wheels under control of the operator.

This invention is drawn to a support and control arrangement 16 for a mold board or blade 17 adapted for multi directional movements under control of the operator to perform various cutting, grading and related construction operations. Although the support and control arrangement is particularly adapted for use on a motor grader, it will be understood that such arrangement also finds application to other types of construction vehicles employing other types of work tools thereon.

Figure 2:
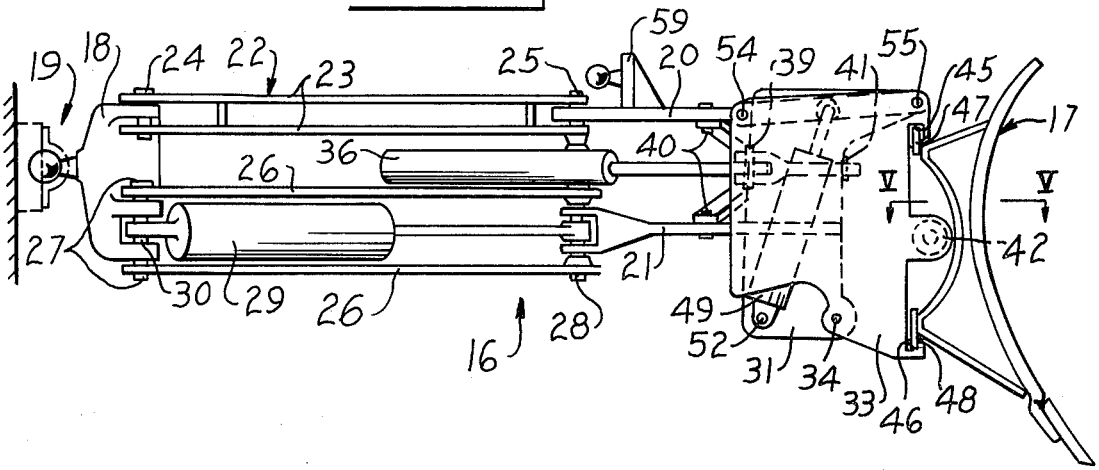
FIG. 2 is an enlarged side elevational view of the support and control arrangement having a mold board or blade mounted forwardly thereon.
Figure 3:
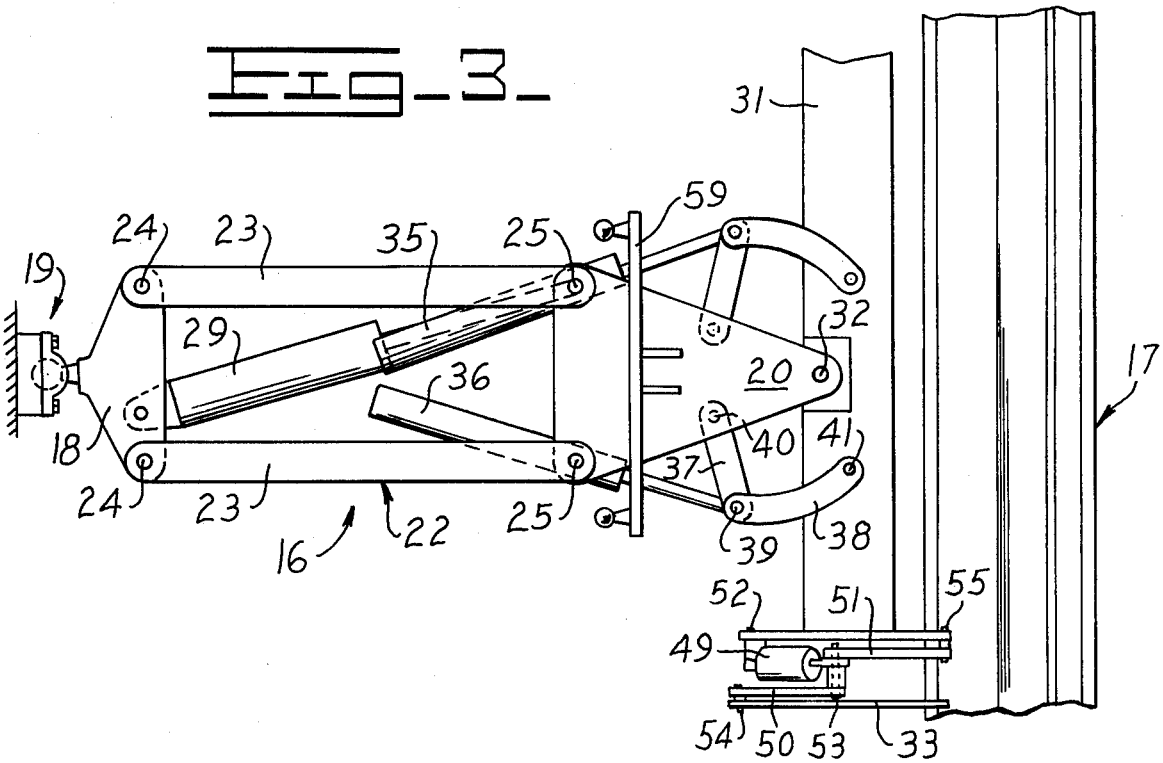
FIG. 3 is a top plan view of the blade support and control arrangement.

Referring to FIGS. 2 and 3, the support and control arrangement comprises a first bracket means 18 having a rearward end thereof pivotally connected for universal movements to frame 12 by a ball and socket connection 19. A second bracket means, comprising a pair of upper and lower bracket members 20 and 21, is pivotally connected to bracket means 18 by a linkage means 22 for maintaining the second bracket means at least substantially parallel relative to the first bracket means upon relative movement thereof, as illustrated by phantom lines in FIG. 4. The linkage means comprises pairs of upper links 23 each pivotally interconnected between the first and second bracket means by pivot pins 24 and 25, respectively, and superimposed pairs of lower links 26 pivotally interconnected between the first and second bracket means by pivot pins 27 and 28, respectively. The links thus form a parallelogram-type linkage to maintain the above-mentioned parallel relationship between the bracket means upon relative movement therebetween.

Figure 4:
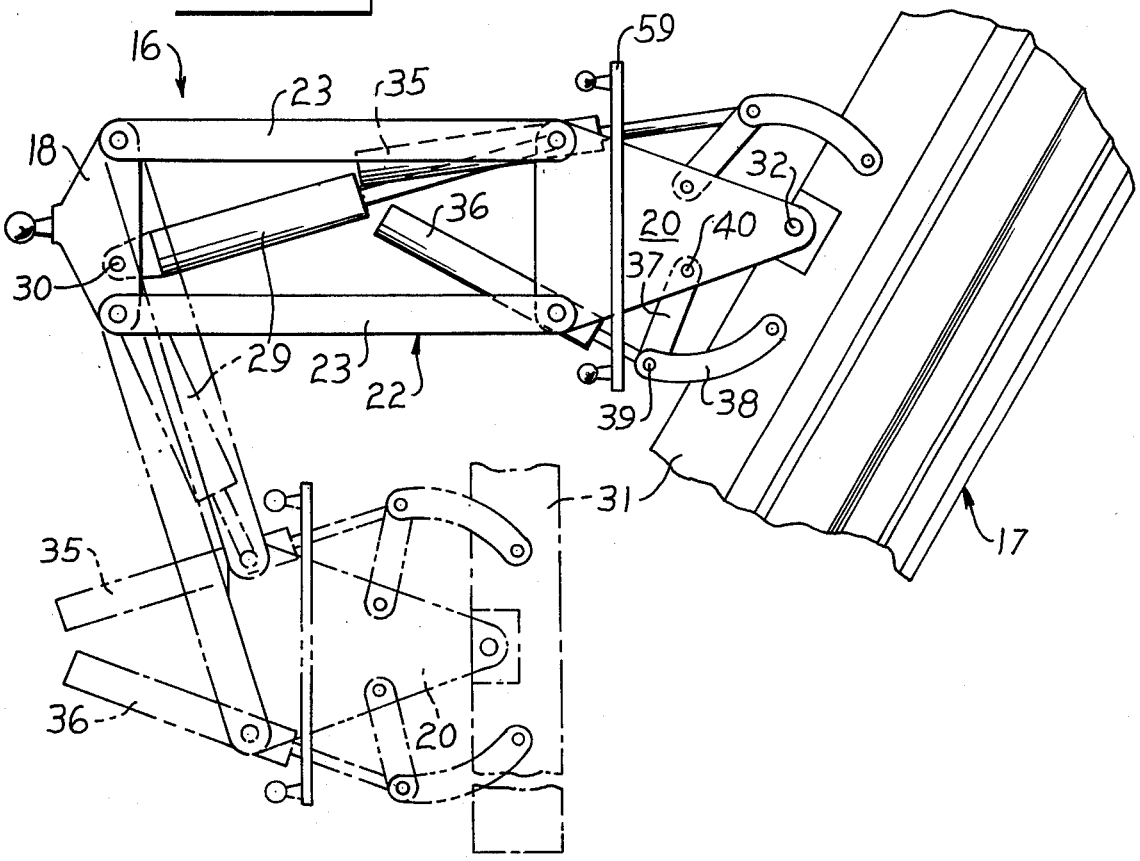
FIG. 4 is a view similar to FIG. 3, but illustrating the blade in a pivoted position and further illustrating a side shifting of the blade in phantom lines.

A first actuating means, preferably in the form of a single double-acting hydraulic cylinder 29, is pivotally interconnected between the first and second bracket means by a pivot pin 30 and one pivot pin 28 to selectively pivot or swing the second bracket means relative to the first bracket means. As shown in FIG. 4, retraction of cylinder 29 will swing the second bracket means to its phantom line position whereas extension of the cylinder will swing the bracket means in a like manner to the opposite side of frame 12. As further illustrated in FIG. 4, the cylinder is diagonally disposed between the first and second bracket means and is further disposed between lower links 26 to prevent interference therebetween.

Blade 17 is part of a work tool assembly which further comprises a support structure including a support member 31. The support member is pivotally connected to the forward ends of brackets 20 and 21 of the second bracket means by a pin 32. A pair of mounting brackets 33 (one shown in FIG. 2) are each pivotally mounted on an outboard end of support member 31 by a pin 34.

Second actuating means, pivotally interconnected between the second bracket means and the work tool assembly, are provided for pivoting the work tool assembly horizontally relative to the second bracket means. The latter actuating means preferably comprises a pair of double-acting hydraulic cylinders 35 and 36, each having its housing pivotally mounted on the second bracket means by common pin 28. Each cylinder has its rod end pivotally connected to first ends of a pair of links 37 and a single link 38 by a common pin 39.

The second end of each link 37 is pivotally connected to a respective one of brackets 20 and 21, comprising the second bracket means, by a pin 40. The second end of each link 38 is pivotally connected to support member 31 by a pin 41. Thus, upon alternate extension and retraction of cylinders 35 and 36, the support member will pivot about pin 32 and relative to the second bracket means, as shown in FIG. 4.

Figure 5:
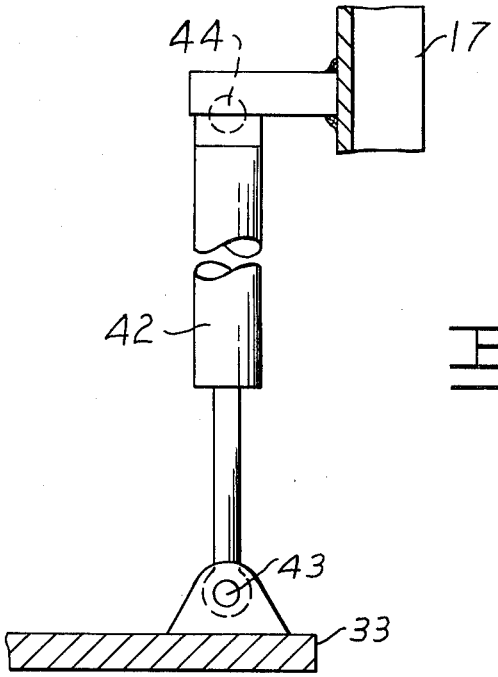
FIG. 5 is an enlarged sectional view, taken in the direction of arrows V—V in FIG. 2.

Referring to FIGS. 2 and 5, a double-acting hydraulic cylinder 42 is pivotally interconnected between a support bracket 33 and blade 17 by a pin 43 and a ball and socket connection 44, respectively. A pair of upper and lower tracks 45 and 46 are defined on support brackets 33 to provide guide means for slidably mounting bearing blocks 47 and 48 therein which are secured to a back side of blade 17. Thus, selective extension and retraction of cylinder 42 will effect side shifting of blade 17 relative to support brackets 33 and support member 31.

As further illustrated in FIGS. 2 and 3, a double-acting hydraulic cylinder 49 is pivotally interconnected between support member 31 and the first ends of a pair of links 50 and 51 by pins 52 and 53, respectively. The second end of link 50 is pivotally connected to an upper and rearward corner of support bracket 33 by a pin 54 whereas the second end of link 51 is pivotally connected to an upper and forward corner of support member 31 by a pin 55. Thus, selective extension and retraction of cylinder 49 will pivot support brackets 33 and blade 17 about pivot pins 34.

Figure 6:
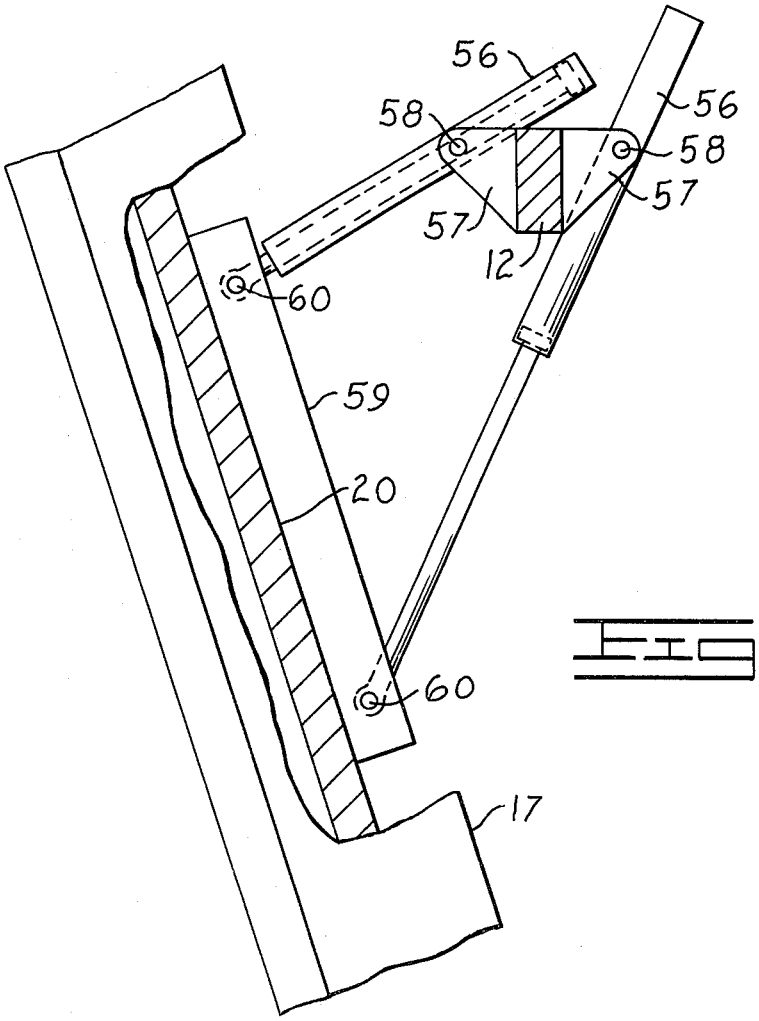
FIG. 6 is an elevational view, taken in the direction of arrows VI—VI in FIG. 1.

Referring to FIGS. 1 and 6, a pair of double-acting hydraulic cylinders or lifting means 56 each has its housing pivotally mounted on a bracket 57, secured to frame 12, by a standard universal connection 58. The rod end of each cylinder is pivotally connected to a bracket 59, secured on upper bracket 20 of the second bracket means, by a ball and socket connection 60. As shown in FIG. 6, the cylinders diverge away from each other in a downward direction and are universally connected between the frame and the second bracket means to swing blade 17 in a vertical plane to dispose it substantially vertically on either side of the frame for side bank cutting purposes.

What is claimed is:

1. A construction vehicle comprising a forwardly extending frame, first bracket means universally connected to said frame, second bracket means, linkage means pivotally interconnected between said first and second bracket means for maintaining said first and second bracket means at least substantially parallel relative to each other upon movement of said second bracket means relative to said first bracket means, first actuating means pivotally interconnected between said first and second bracket means for moving said second bracket means relative to said first bracket means, a work tool assembly pivotally mounted on said second bracket means, and a second actuating means pivotally interconnected between said second bracket means and said work tool assembly for pivoting said work tool assembly relative to said second bracket means.

2. The construction vehicle of claim 1 wherein said construction vehicle constitutes a motor grader and said work tool assembly comprises a mold board.

3. The construction vehicle of claim 2 wherein said frame extends substantially forwardly of said mold board and is supported on a pair of steerable road wheels and further comprising steering gear and valve means mounted on the forward end of said frame for selectively steering said road wheels.

4. The construction vehicle of claim 1 further comprising lifting means pivotally interconnected between said frame and said second bracket means for moving said work tool from a normally disposed horizontal disposition to a generally vertically disposed vertical disposition on either side of said frame.

5. The construction vehicle of claim 4 wherein said lifting means comprises a pair of double-acting hydraulic cylinders pivotally mounted on either side of said frame.

6. The construction vehicle of claim 1 wherein said first bracket means is universally connected to said frame by a ball and socket connection.

7. The construction vehicle of claim 1 wherein said linkage means comprises a parallelogram-type linkage including upper and lower pairs of links pivotally interconnected between said first and said second bracket means.

8. The construction vehicle of claim 1 wherein said first actuating means constitutes a single double-acting hydraulic cylinder.

9. The construction vehicle of claim 8 wherein said cylinder is diagonally disposed relative to said first and second bracket means.

10. The construction vehicle of claim 1 wherein said second actuating means comprises a pair of double-acting hydraulic cylinders each pivotally mounted on said second bracket means.

11. The construction vehicle of claim 10 wherein said second actuating means further comprises pairs of links having first ends thereof pivotally connected to each of said cylinders and having second ends thereof pivotally connected to said second bracket means and to said work tool assembly, respectively.

12. The construction vehicle of claim 1 wherein said work tool assembly comprises a support member pivotally connected to said second bracket means and a blade mounted on said support member.

13. The construction vehicle of claim 12 wherein said work tool assembly further comprises at least one mounting bracket pivotally mounted on said support member and actuating means pivotally interconnected between said support member and said mounting bracket for pivoting said mounting bracket on said support member, said blade mounted on said mounting bracket.

14. The construction vehicle of claim 12 wherein said work tool assembly further comprises at least one mounting bracket mounted on said support member, track means defined on said mounting bracket and slidably mounting said blade thereon for shifting movements therealong and actuating means interconnected between said mounting bracket and said blade for selectively shifting said blade relative to said mounting bracket.

15. A construction vehicle comprising a forwardly extending frame, first bracket means pivotally connected to said frame, second bracket means, linkage means pivotally interconnected between said first and second bracket means for maintaining said first and second bracket means at least substantially parallel relative to each other upon movement of said second bracket means relative to said first bracket means.

first actuating means pivotally interconnected between said first and second bracket means for moving said second bracket means relative to said first bracket means, a work tool assembly pivotally mounted on said second bracket means, and second actuating means pivotally interconnected between said second bracket means and said work tool assembly for pivoting said work tool assembly relative to said second bracket means, said second actuating means comprising a pair of double-acting hydraulic cylinders each pivotally mounted on said second bracket means and pairs of links having first ends thereof pivotally connected to each of said cylinders and having second ends thereof pivotally connected to said second bracket means and to said work tool assembly, respectively.

16. A construction vehicle comprising a forwardly extending frame, first bracket means pivotally connected to said frame, second bracket means, linkage means pivotally interconnected between said first and second bracket means for maintaining said first and second bracket means at least substantially parallel relative to each other upon movement of said second bracket means relative to said first bracket means, first actuating means pivotally interconnected between said first and second bracket means for moving said second bracket means relative to said first bracket means, a work tool assembly pivotally mounted on said second bracket means comprising a support member pivotally connected to said second bracket means, a blade mounted on said support member, at least one mounting bracket pivotally mounted on said support member and actuating means pivotally interconnected between said support member and said mounting bracket for pivoting said mounting bracket on said support member, said blade mounted on said mounting bracket, and second actuating means pivotally interconnected between said second bracket means and said work tool assembly for pivoting said work tool assembly relative to said second bracket means.

17. A construction vehicle comprising a forwardly extending frame, first bracket means pivotally connected to said frame, second bracket means, linkage means pivotally interconnected between said first and second bracket means for maintaining said first and second bracket means at least substantially parallel relative to each other upon movement of said second bracket means relative to said first bracket means, first actuating means pivotally interconnected between said first and second bracket means for moving said second bracket means relative to said first bracket means, a work tool assembly pivotally mounted on said second bracket means comprising a support member pivotally connected to said second bracket means, a blade mounted on said support member, at least one mounting bracket mounted on said support member, track means defined on said mounting bracket and slidably mounting said blade thereon for shifting movments therealong and actuating means interconnected between said mounting bracket and said blade for selectively shifting said blade relative to said mounting bracket, and second actuating means pivotally interconnected between said second bracket means and said work tool assembly for pivoting said work tool assembly relative to said second bracket means.

* * * * *